US010373538B2

(12) United States Patent
Cao et al.

(10) Patent No.: US 10,373,538 B2
(45) Date of Patent: Aug. 6, 2019

(54) JUDGING METHOD OF ARRAY TEST RELIABILITY, TESTING METHOD AND DEVICE OF ORGANIC LIGHT EMITTING BACKPLANE

(71) Applicant: BOE TECHNOLOGY GROUP CO., LTD., Beijing (CN)

(72) Inventors: Kun Cao, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 369 days.

(21) Appl. No.: 15/168,775

(22) Filed: May 31, 2016

(65) Prior Publication Data

US 2017/0053577 A1 Feb. 23, 2017

(30) Foreign Application Priority Data

Aug. 19, 2015 (CN) ..... 2015 1 0512980

(51) Int. Cl.

*G09G 3/00* (2006.01)
*G09G 3/3258* (2016.01)
*G09G 3/3266* (2016.01)

(52) U.S. Cl.

CPC ..... *G09G 3/006* (2013.01); *G09G 3/3258* (2013.01); *G09G 3/3266* (2013.01); *G09G 2330/10* (2013.01)

(58) Field of Classification Search

None

See application file for complete search history.

(56) References Cited

U.S. PATENT DOCUMENTS

2005/0219168 A1* 10/2005 Shirasaki ..... G09G 3/006 345/76
2011/0279128 A1* 11/2011 Von Staudt ..... G09G 3/006 324/538
2012/0206145 A1* 8/2012 Kim ..... G09G 3/006 324/414
2012/0306939 A1* 12/2012 Choi ..... G09G 3/006 345/690
2017/0046992 A1* 2/2017 Zhou ..... G09G 3/006

* cited by examiner

*Primary Examiner* — Amare Mengistu
*Assistant Examiner* — Sarvesh J Nadkarni
(74) *Attorney, Agent, or Firm* — Nath, Goldberg & Meyer; Joshua B. Goldberg; Stanley Protigal

(57) ABSTRACT

A judging method of array test reliability, comprising: Step 1, taking at least one of organic light emitting backplanes subjected to an array test as a sample substrate; Step 2, performing a scan on pixels of the sample substrate row by row and providing a data voltage signal; Step 3, detecting a current that is output to an anode of each pixel from a pixel circuit layer; Step 4, comparing the current that is output to the anode of each pixel from the pixel circuit layer with a predefined current, judging that the pixel is a defective pixel when the two are inconsistent; Step 5, comparing a judgment result of each pixel with a test result of the array test, judging that the array test is reliable when the two are consistent, judging that the array test is unreliable when the two are inconsistent.

7 Claims, 5 Drawing Sheets

JUDGING METHOD OF ARRAY TEST RELIABILITY, TESTING METHOD AND DEVICE OF ORGANIC LIGHT EMITTING BACKPLANE

FIELD OF THE INVENTION

The present invention relates to the field of display technology, and particularly relates to a judging method of array test reliability, a testing method of an organic light emitting backplane and a testing device of an organic light emitting backplane.

BACKGROUND OF THE INVENTION

A manufacturing procedure of an active-matrix organic light emitting diode (AMOLED) display panel comprises: a manufacturing procedure of a backplane (BP), a manufacturing procedure of an organic emitting layer (EL) and a packaging procedure. During the manufacturing procedure of the backplane, the backplane is generally tested by using a technique such as array test to prevent defective backplanes from entering the subsequent procedures, thereby to avoid production of defective display panels, and meanwhile, stability of the array test technique may be monitored.

There may be an error in an array test, and in order to improve reliability of the array test, it needs to put some backplanes into the manufacturing procedure of the organic light emitting layer and the packaging procedure to form a display panel, then the display panel displays during a cell test stage, by comparing display results of the display panel with test results of the array test, test conditions of the array test may be revised. However, since cost for manufacturing the organic light emitting layer is high, and the manufactured organic light emitting layer may also be defective, it is not easy to distinguish the defect of the organic light emitting layer from the defect in the array test.

SUMMARY OF THE INVENTION

An object of the present invention is to provide a judging method of array test reliability, a testing method of an organic light emitting backplane and a testing device of an organic light emitting backplane, which can judging reliability of an array test without manufacturing a light emitting layer, thus influences of the light emitting layer on judgment results are avoided.

In order to achieve the above object, the present invention provides a judging method of array test reliability of an organic light emitting backplane, the organic light emitting backplane comprising a pixel circuit layer and an anode layer, the anode layer comprising an anode in each pixel of the organic light emitting backplane, the judging method of array test reliability comprising:

Step 1, taking at least one of organic light emitting backplanes subjected to an array test as a sample substrate;

Step 2, performing a scan on pixels of the sample substrate row by row and providing a data voltage signal;

Step 3, detecting a current that is output to the anode of each pixel from the pixel circuit layer;

Step 4, comparing the current that is output to the anode of each pixel from the pixel circuit layer with a predefined current, and judging that a pixel is a defective pixel when the current that is output to the anode of the pixel is inconsistent with the predefined current; and Step 5, comparing a judgment result of each pixel with a test result of the array test, judging that the array test is reliable when the judgment result is consistent with the test result, and judging that the array test is unreliable when the judgment result is inconsistent with the test result.

Preferably, the judging method of array test reliability further comprises a step to be performed between the Step 1 and the Step 2:

Step 15, electrically connecting the anodes in a plurality of pixels, wherein, the Step 3 comprises:

detecting a corresponding anode current every time when one row of pixels are scanned;

the Step 4 comprises:

Sub-step 41, comparing a detected anode current with the predefined current, judging that there is no defective pixel in the row of pixels corresponding to the detected anode current when the detected anode current is consistent with the predefined current, and judging that there is at least one defective pixel in the row of pixels corresponding to the detected anode current when the detected anode current is inconsistent with the predefined current;

Sub-step 42, providing a scanning signal to the row of pixels having the defective pixel, and providing a data voltage signal sequentially to each pixel;

Sub-step 43, detecting an anode current corresponding to each pixel; and

Sup-step 44, comparing each anode current with the predefined current, and judging that a pixel corresponding to an anode current among the row of pixels having the defective pixel is the defective pixel when the anode current is inconsistent with the predefined current.

Preferably, the Step 15 comprises: providing a cathode layer on the anode layer of the sample substrate to electrically connect the anodes in the pixels.

Preferably, a first image is generated from the test result of the array test performed on the sample substrate, the first image comprises a plurality of pixel points corresponding to the pixels of the sample substrate, when a pixel is judged as a normal pixel in the array test, the pixel point in the first image corresponding to the pixel has a first color, and when a pixel is judged as a defective pixel in the array test, the pixel point in the first image corresponding to the pixel has a second color;

the judging method of array test reliability further comprises a step to be performed between the Step 4 and the Step 5: generating a second image from the judgment result of the Step 4, the second image comprising a plurality of pixel points corresponding to the pixels of the sample substrate, when a pixel is judged as a normal pixel in the Step 4, the pixel point in the second image corresponding to the pixel has the first color, and when a pixel is judged as a defective pixel in the Step 4, the pixel point in the second image corresponding to the pixel has the second color;

the Step 5 comprises: comparing the first image and the second image, and judging that the array test is reliable when each pixel point in the first image has the same color as that of the corresponding pixel point in the second image, otherwise, judging that the array test is unreliable.

Correspondingly, the present invention also provides a testing method of an organic light emitting backplane, comprising steps of:

performing an array test on a plurality of organic light emitting backplanes; and judging reliability of the array test by the above judging method of array test reliability provided by the present invention;

when it is judged that the array test is unreliable, the testing method comprises: adjusting the array test, and performing the adjusted array test on the sample substrate until the test result of the array test is consistent with the judgment result in the Step 4.

Preferably, the step of adjusting the array test comprises: adjusting test conditions of the array test.

Correspondingly, the present invention also provides a testing device of an organic light emitting backplane, the organic light emitting backplane comprising a pixel circuit layer and an anode layer, the anode layer comprising an anode in each pixel of the organic light emitting backplane, the testing device of the organic light emitting backplane comprising:

an array test module configured to perform an array test on a plurality of organic light emitting backplanes;

a driving module configured to scan pixels of a sample substrate row by row and provide a data voltage signal, the sample substrate being at least one of the organic light emitting backplanes subjected to the array test;

a current detecting module configured to detect a current that is output to an anode of each pixel from a pixel circuit layer of the sample substrate;

a first judging module configured to compare the current detected by the current detecting module with a predefined current, and judge that a pixel is a defective pixel when a corresponding current detected by the current detecting module is inconsistent with the predefined current;

a second judging module configured to compare a judgment result of the first judging module with a test result of the array test module, judge that the array test performed by the array test module is reliable when the judgment result is consistent with the test result, and judge that the array test performed by the array test module is unreliable when the judgment result is inconsistent with the test result;

an adjusting module configured to, when the second judging module judges that the array test performed by the array test module is unreliable, adjust the array test module until the test result of the array test performed by the array test module on the sample substrate is consistent with the judgment result of the first judging module.

Preferably, the pixel circuit layer of the sample substrate comprises a writing transistor, a driving transistor, a storage capacitor and a switching transistor in each pixel, wherein a first electrode of the driving transistor is connected to a high level input terminal, a second electrode of the driving transistor is connected to the anode of the pixel, a gate of the driving transistor is connected to a second electrode of the writing transistor, and a first electrode of the switching transistor is connected to the anode of the pixel; the sample substrate further comprises a plurality of first scanning lines, a plurality of second scanning lines, a plurality of data lines and a plurality of detecting lines, wherein the gates of the writing transistors in a same row are connected to the corresponding first scanning line, the first electrodes of the writing transistors in a same column are connected to the corresponding data line, the gates of the switching transistors in a same row are connected to the corresponding second scanning line, and the second electrodes of the switching transistors in a same column are connected to the corresponding detecting line;

when the driving module scans the pixels of the sample substrate row by row, a scanning signal is simultaneously provided to the first scanning line and the second scanning line corresponding to the scanned row of pixels, the current detecting module comprises a first detecting sub-module configured to detect the current flowing through the detecting line.

Preferably, the anodes in the pixels of the sample substrate are electrically connected, and the current detecting module comprises a second detecting sub-module capable of detecting a corresponding anode current every time when one row of pixels are scanned;

the first judging module compares the anode current detected by the second detecting sub-module with the predefined current, judges that there is no defective pixel in the row of pixels corresponding to the detected anode current when the detected anode current is consistent with the predefined current, and judges that there is at least one defective pixel in the row of pixels corresponding to the detected anode current when the detected anode current is inconsistent with the predefined current;

the driving module provides a scanning signal to the row of pixels having the defective pixel, and provides a data voltage signal sequentially to each pixel, so that the second detecting sub-module detects the anode current corresponding to each pixel, and the first judging module compares each anode current detected by the second detecting sub-module with the predefined current and judges, when an anode current is inconsistent with the predefined current, that the pixel corresponding to the anode current among the row of pixels having the defective pixel is the defective pixel.

Preferably, a cathode layer is provided on the anode layer of the sample substrate to electrically connect the anodes in the pixels.

Preferably, the second judging module comprises an image generating sub-module and an image comparing sub-module, the image generating sub-module generates a first image from the test result of the array test performed by the array test module on the sample substrate, and generates a second image from the judgment result of the first judging module on the sample substrate, wherein the first image comprises a plurality of pixel points corresponding to the pixels of the sample substrate, when the array test module judges that a pixel is a normal pixel, the pixel point in the first image corresponding to the pixel has a first color, and when the array test module judges that a pixel is a defective pixel, the pixel point in the first image corresponding to the pixel has a second color; and, the second image also comprises a plurality of pixel points corresponding to the pixels of the sample substrate, when the first judging module judges that a pixel is a normal pixel, the pixel point in the second image corresponding to the pixel has the first color, and when the first judging module judges that a pixel is a defective pixel, the pixel point in the second image corresponding to the pixel has the second color;

and the image comparing sub-module is configured to compare the first image and the second image, when each pixel point in the first image has the same color as that of the corresponding pixel point in the second image, it is judged that the array test performed by the array test module is reliable, otherwise, it is judged that the array test performed by the array test module is unreliable.

In the present invention, the current of the anode layer of the sample substrate is detected, by comparing the detected current and the predefined current, whether a pixel of the organic light emitting backplane is the defective pixel is judged, and whether the test result of the array test is reliable is judged in accordance with the judgment result obtained by current detecting, so that the test conditions of the array test may be adjusted subsequently to improve accuracy of the next array test. Therefore, the present invention can judge the reliability of the array test without manufacturing the light emitting layer, the cost is reduced, the influences of the defective light emitting layer on the test result is avoided, and the accuracy of the judgment of array test reliability is improved.

BRIEF DESCRIPTION OF THE DRAWINGS

The drawings, as a part of the specification, are provided for further understanding of the present invention. The drawings and the following embodiments are used to explain the present invention, but are not intended to limit the present invention. In the drawings.

REFERENCE NUMERALS

10, array test module; 20, driving module; 30, current detecting module;

31, first detecting sub-module; 32, second detecting sub-module;

40, first judging module; 50, second judging module; 60, adjusting module;

51, image generating sub-module; 52, image comparing sub-module;

DATA, data line; G1, first scanning line; G2, second scanning line;

ELVDD, high level signal terminal; T1, writing transistor;

T2, driving transistor; T3, switching transistor; SENSE, detecting line;

C, storage capacitor; 71, anode; 72, cathode.

DESCRIPTION OF THE PREFERRED EMBODIMENT

Specific embodiments of the present invention will be described in detail below in conjunction with the accompanying drawings. It should be understood that, the specific embodiments are merely described herein for illustrating and explaining the present invention, but are not intended to limit the present invention.

Figure 1:
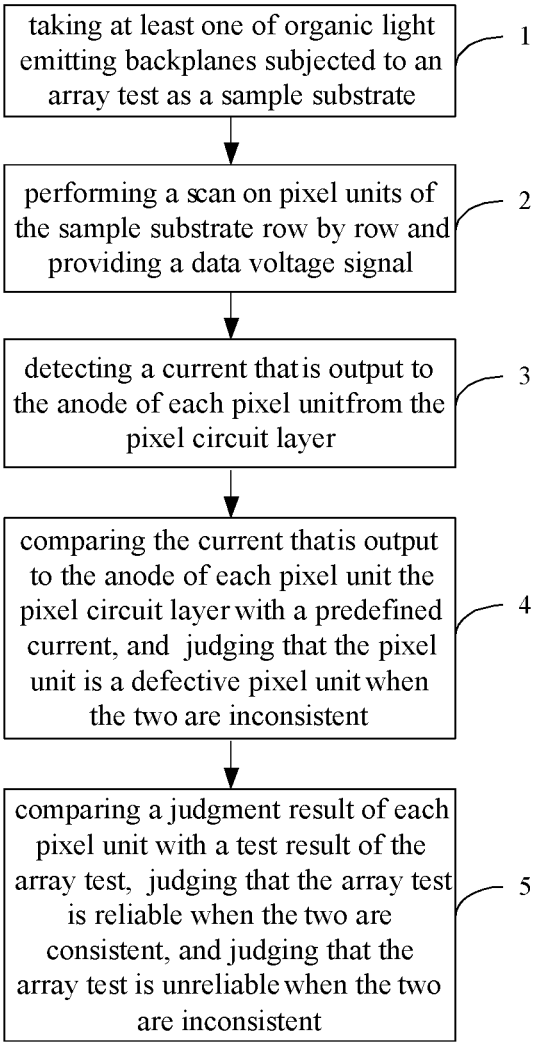
FIG. 1 is a flow chart of a judging method of array test reliability in an embodiment of the present invention.

As an aspect of the present invention, a judging method of array test reliability of an organic light emitting backplane is provided, the organic light emitting backplane comprising a pixel circuit layer and an anode layer, the anode layer comprising an anode in each pixel of the organic light emitting backplane, as shown in FIG. 1, the judging method of array test reliability comprising:

Step 1, taking at least one of organic light emitting backplanes subjected to an array test as a sample substrate;

Step 2, performing a scan on pixels of the sample substrate row by row and providing a data voltage signal;

Step 3, detecting a current that is output to the anode of each pixel from the pixel circuit layer;

Step 4, comparing the current that is output to the anode of each pixel from the pixel circuit layer with a predefined current, and judging that a pixel is a defective pixel when the current that is output to the anode of the pixel from the pixel circuit layer is inconsistent with the predefined current; and Step 5, comparing a judgment result of each pixel with a test result of the array test, judging that the array test is reliable when the judgment result is consistent with the test result, and judging that the array test is unreliable when the judgment result is inconsistent with the test result.

In the prior art, after performing array test on backplanes of organic light emitting display panels, in order to judge reliability of the array test, a light emitting layer is manufactured on some of the backplanes and a packaging procedure is performed to form the organic light emitting display panels. It is judged whether the test result of the array test is reliable in accordance with display effect of the display panel, so as to determine whether or not to adjust test conditions of the array test. By contrast, in the present invention, the current of the anode layer of the sample substrate is detected, whether a pixel of the organic light emitting backplane is a defective pixel is judged by comparing the detected current with the predefined current, and whether the test result of the array test is reliable is judged in accordance with the judgment result obtained by current detecting, so that the test conditions of the array test are adjusted subsequently to improve the accuracy of the next array test. Therefore, the present invention can judge reliability of the array test without manufacturing the light emitting layer, the cost is reduced, the influences of the defective light emitting layer on the test result is reduced, and the accuracy of the reliability judgment is improved.

It should be understood that, when a data voltage signal is provided to each pixel, the detecting circuit for detecting the current is directly or indirectly connected to the anode layer to form a loop, thus there is a current flowing through the anode even there is no light emitting layer.

The predefined current refers to as the current flowing through the anode layer when there is no defective pixel.

When the current that is output to the anode of each pixel from the pixel circuit layer is detected, the anode current of each pixel may be respectively detected, for example, the anode of each pixel is connected to the detecting circuit, and every time when one row of pixels are scanned, the detecting circuit detects the anode current of each pixel respectively. Alternatively, the anode current of all the pixels may be detected uniformly, since the data voltage signal is provided to the pixels row by row, the row of the pixels having the defective pixel may be detected by uniform detecting, and then the specific position of the defective pixel in the row is specifically detected.

As a specific implementation of the present invention, the judging method of array test reliability further comprises a step to be performed between the Step 1 and the Step 2:

Step 15, electrically connecting the anodes in the pixels of the sample substrate.

In this case, the Step 3 comprises: detecting a corresponding anode current every time when one row of pixels are scanned.

In this case, the Step 4 comprises: Sub-step 41, comparing a detected anode current with the predefined current, judging that there is no defective pixel in the row of pixels corresponding to the detected anode current when the detected anode current is consistent with the predefined current, and judging that there is at least one defective pixel in the row of pixels corresponding to the detected anode current when the detected anode current is inconsistent with the predefined current;

Sub-step 42, providing a scanning signal to the row of pixels having the defective pixel, and providing a data voltage signal sequentially to each pixel;

Sub-step 43, detecting an anode current corresponding to each pixel; and

Sub-step 44, comparing each anode current with the predefined current, and judging that a pixel corresponding to an anode current among the row of pixels having the defective pixel is the defective pixel when the anode current is inconsistent with the predefined current.

In order to facilitate detecting, the sample substrate may be divided into a plurality of regions, each region comprises a plurality of rows and columns of pixels, and the regions are detected sequentially. For example, when an $m^{th}$ row of pixels in an A region are scanned, it is judged that there is at least one defective pixel in the $m^{th}$ row of pixels in the A region if the detected anode current is inconsistent with the predefined current. In order to determine the specific position of the defective pixel, a scanning signal is provided to the $m^{th}$ row of pixels in the A region, and a data voltage signal is provided to the $m^{th}$ row of pixels in the A region sequentially. An anode current corresponding to each pixel is detected, and when a detected anode current is inconsistent with the predefined current, the corresponding pixel is judged as the defective pixel. That is, when determining the specific position of the defective pixel, it is only necessary to provide the data voltage signal to the plurality of data lines sequentially.

Further, the Step 15 may further comprise: providing a cathode layer on the anode layer of the sample substrate to electrically connect the anodes in the pixels. There is no light emitting layer between the anode layer and the cathode layer, thus the cost is reduced and the influences of the defective light emitting layer on the test result are avoided.

The judgment result in the Step 4 and the test result of the array test may be compared by various methods in the Step 5. Generally, a first image may be generated from the test result of the array test performed on the sample substrate, and the first image comprises a plurality of pixel points corresponding to the pixels of the sample substrate. When a pixel is judged as a normal pixel in the array test, the pixel point in the first image corresponding to the pixel has a first color, and when a pixel is judged as a defective pixel in the array test, the pixel point in the first image corresponding to the pixel has a second color. In this case, the judging method of array test reliability may further comprise a step to be performed between the Step 4 and the Step 5: generating a second image from the judgment result of the Step 4, the second image comprising a plurality of pixel points corresponding to the pixels of the sample substrate. When a pixel is judged as a normal pixel in the Step 4, the pixel point in the second image corresponding to the pixel has the first color, and when a pixel is judged as a defective pixel in the Step 4, the pixel point in the second image corresponding to the pixel has the second color. In this case, the Step 5 comprises: comparing the first image and the second image, and judging that the array test is reliable when each pixel point in the first image has the same color as that of the corresponding pixel point in the second image, otherwise, judging that the array test is unreliable.

For example, the first color is green, and the second color is red, that is, when the test result of the array test indicates that an $x^{th}$ pixel is a normal pixel, the pixel point in the first image corresponding to the $x^{th}$ pixel has a green color, and when the test result of the array test indicates that a $y^{th}$ pixel is a defective pixel, the pixel point in the first image corresponding to the $y^{th}$ pixel has a red color. Similarly, when a $p^{th}$ pixel is judged as a normal pixel in the Step 4, the pixel point in the second image corresponding to the $p^{th}$ pixel has a green color, and when a $q^{th}$ pixel is judged as the defective pixel in the Step 4, the pixel point in the second image corresponding to the $q^{th}$ pixel has a red color. Therefore, whether the judgment result of the Step 4 is consistent with the test result of the array test is judged in accordance with color distributions of the first and second images, thereby whether the array test is reliable may be judged visually.

As another aspect of the present invention, there is provided a testing method of an organic light emitting backplane, comprising steps of:

performing an array test on a plurality of organic light emitting backplanes; and judging reliability of the array test by the above judging method of array test reliability provided by the present invention;

when it is judged that the array test is unreliable, the testing method comprises: adjusting the array test, and performing the adjusted array test on the sample substrate until the test result of the array test is consistent with the judgment result in the Step 4.

Certainly, when it is judged that the array test is reliable, the array test may be directly used for testing the next batch of organic light emitting backplanes.

There are certain test conditions of the array test, by which the pixels of the sample substrate are tested, and adjusting the array test may comprise adjusting the test conditions of the array test. For example, a data voltage signal is provided to each pixel of the organic light emitting backplane when the array test is performed, and whether a pixel is a defective pixel is judged by detecting a voltage between the anode of the pixel and a low level, in which the pixel is judged as a normal pixel when the voltage between the anode of the pixel and the low level is larger than the predefined voltage and the pixel is judged as a defective pixel when the voltage between the anode of the pixel and the low level is smaller than the predefined voltage. In this case, when it is judged that the array test is unreliable in the above judging method of array test reliability, the predefined voltage may be adjusted to prevent, in the next array test, a normal pixel from being judged as a defective pixel, or a defective pixel from being judged as a normal pixel.

The reliability of the array test performed on the organic light emitting backplane is judged by using the judging method of array test reliability of the present invention, and the test conditions thereof are adjusted when it is judged that the array test is unreliable, so that the test result of the array test becomes more reliable. Thus, whether a pixel of another organic light emitting backplane is a defective pixel can be judged accurately, meanwhile, the reliability of the array test is judged without manufacturing the light emitting layer, thus the cost for the whole test procedure is reduced, the influences of the defective light emitting layer on the test result are avoided, and the reliability of the test is improved.

Figure 2:
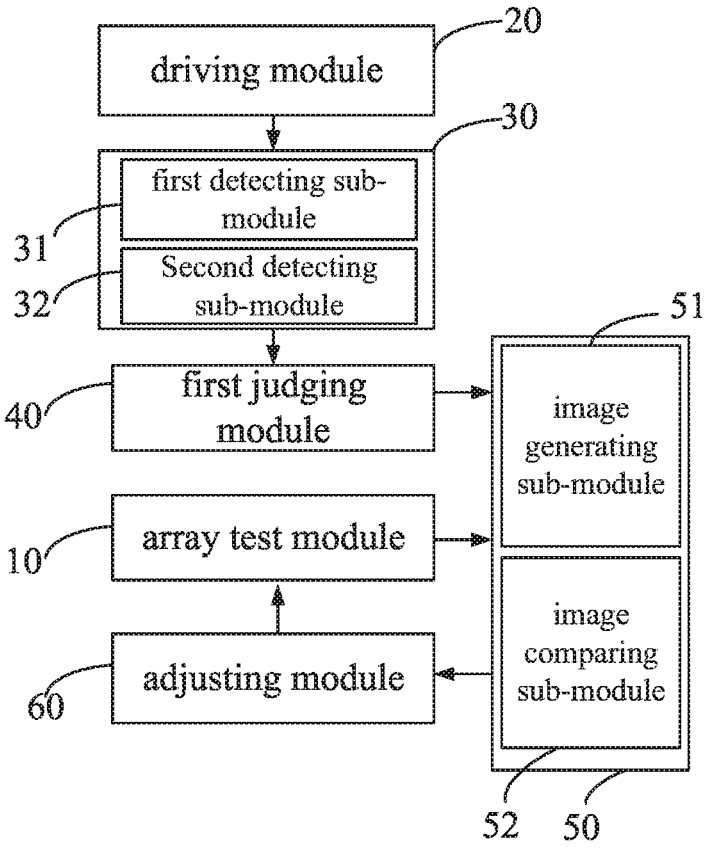
FIG. 2 is a structural diagram of a testing device of an organic light emitting backplane in an embodiment of the present invention.

As still another aspect of the present invention, there is provided a testing device of an organic light emitting backplane, the organic light emitting backplane comprising a pixel circuit layer and an anode layer, the anode layer comprising an anode in each pixel of the organic light emitting backplane, as shown in FIG. 2, the testing device of the organic light emitting backplane comprising:

an array test module 10 configured to perform an array test on a plurality of organic light emitting backplanes;

a driving module 20 configured to scan pixels of a sample substrate row by row and provide a data voltage signal, the sample substrate being at least one of the organic light emitting backplanes subjected to the array test;

a current detecting module 30 configured to detect a current that is output to an anode of each pixel from a pixel circuit layer of the sample substrate;

a first judging module 40 configured to compare the current detected by the current detecting module 30 and a predefined current, and judge that a pixel is a defective pixel when a corresponding current detected by the current detecting module 30 is inconsistent with the predefined current;

a second judging module 50 configured to compare a judgment result of the first judging module 40 with a test result of the array test module 10, judge that the array test performed by the array test module 10 is reliable when the judgment result is consistent with the test result, and judge that the array test performed by the array test module 10 is unreliable when the judgment result is inconsistent with the test result; and an adjusting module 60 configured to, when the second judging module 50 judges that the array test performed by the array test module 10 is unreliable, adjust the array test module 10 until the test result of the array test performed by the array test module 10 on the sample substrate is consistent with the judgment result of the first judging module 40.

The driving module 20 may comprise a gate driving circuit for providing a scanning signal and a source driving circuit for providing the data voltage signal.

Figure 3:
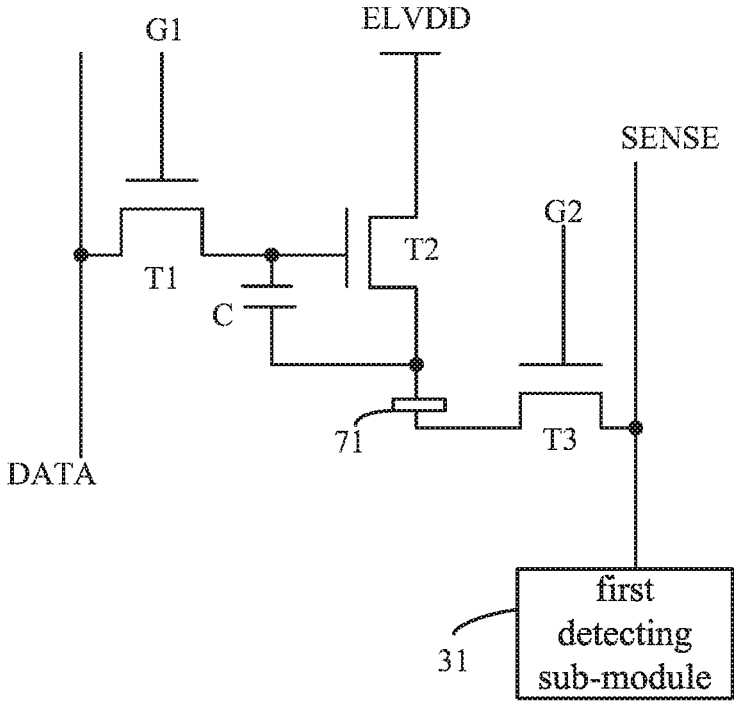
FIG. 3 is a schematic diagram when a current flowing through an anode is detected in an embodiment of the present invention.

Specifically, as shown in FIG. 3, the pixel circuit layer of the sample substrate may comprise a writing transistor T1, a driving transistor T2, a storage capacitor C and a switching transistor T3 in each pixel, in which a first electrode of the driving transistor T2 is connected to a high level input terminal ELVDD, a second electrode of the driving transistor T2 is connected to the anode 71 of the pixel, a gate of the driving transistor T2 is connected to a second electrode of the writing transistor T1, and a first electrode of the switching transistor T3 is connected to the anode 71 of the pixel. The sample substrate further comprises a plurality of first scanning lines, a plurality of second scanning lines, a plurality of data lines and a plurality of detecting lines, in which the gates of the writing transistors T1 in a same row are connected to the corresponding first scanning line G1, the first electrodes of the writing transistors T1 in a same column are connected to the corresponding data line DATA, the gates of the switching transistors T3 in a same row are connected to the corresponding second scanning line G2, and the second electrodes of the switching transistors T3 in a same column are connected to a corresponding detecting line SENSE.

When the driving module 20 scans the pixels of the sample substrate row by row, a scanning signal is simultaneously provided to the first scanning line G1 and the second scanning line G2 corresponding to the scanned row of pixels. The current detecting module 30 may comprise a first detecting sub-module 31 configured to detect the current flowing through the detecting line SENSE.

When the first scanning line G1 and the second scanning line G2 receive the scanning signal, the writing transistors T1, the driving transistors T2 and the switching transistors T3 in each row of pixels are turned on, the storage capacitor C is charged by the data voltage signal of the data line DATA through the writing transistor T1, and since the driving transistor T2 is turned on, the high level signal terminal ELVDD and the anode 71 of the pixel are conducting. The current flows into the current detecting circuit through the anode 71 and the switching transistor T3 so that the current detecting circuit detects the current flowing through each anode 71 in the scanned row of pixels.

Figure 5:
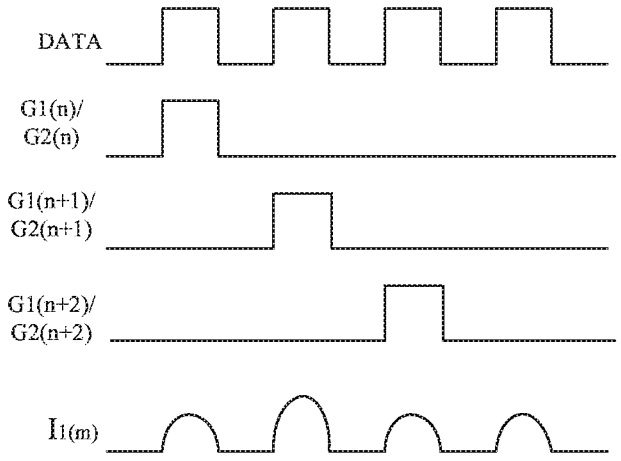
FIG. 5 is a waveform diagram of signals of respective signal lines in an embodiment of the present invention.

FIG. 5 shows a waveform diagram of the data voltage signal of one data line DATA. In order to facilitate detecting, the data voltage signals of other data lines may have the same waveforms as that of the data voltage signal shown in FIG. 5. $I_1(m)$ in FIG. 5 schematically shows a waveform of a current flowing through a $m^{th}$ detecting line, and when a $(n+1)^{th}$ row of pixels are scanned, if the detected current $I_1(m)$ is different from the predefined current, the pixel in the $(n+1)^{th}$ row and the $m^{th}$ column is judged as a defective pixel.

Further, the anodes in the pixels of the sample substrate may be electrically connected, and the current detecting module 30 may further comprise a second detecting sub-module 32 capable of detecting a corresponding anode current every time when one row of pixels are scanned.

The first judging module 40 compares the anode current detected by the second detecting sub-module 32 with the predefined current, judges that there is no defective pixel in the row of pixels corresponding to the detected anode current when the detected anode current is consistent with the predefined current, and judges that there is at least one defective pixel in the row of pixels corresponding to the detected anode current when the detected anode current is inconsistent with the predefined current.

The driving module 20 provides a scanning signal to the row of pixels having the defective pixel, and provides a data voltage signal sequentially to each pixel, so that the second detecting sub-module 32 detects the anode current corresponding to each pixel. The first judging module 40 compares each anode current detected by the second detecting sub-module 32 with the predefined current, and judges, when an anode current is inconsistent with the predefined current, that the pixel corresponding to the anode current (i.e., the anode current being inconsistent with the predefined current) among the row of pixels having the defective pixel is the defective pixel.

Figure 4:
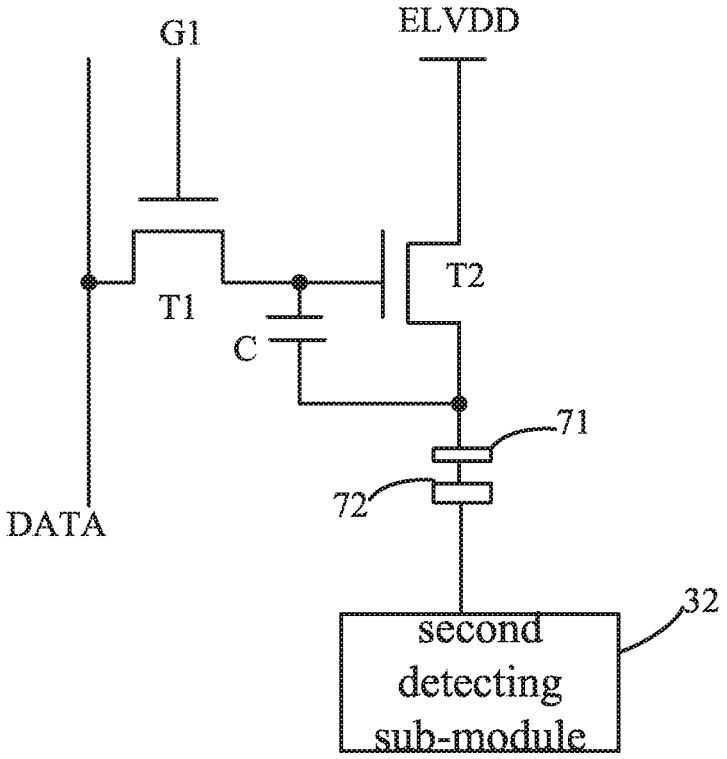
FIG. 4 is a schematic diagram when a current flowing through a cathode layer is detected in an embodiment of the present invention.

Specifically, as shown in FIG. 4, a cathode layer 72 may be provided on the anode layer of the sample substrate to electrically connect the anodes 71 in the pixels. The second detecting sub-module 32 is connected to the cathode layer 72, and the anode current detected by the second detecting sub-module 32 is the current flowing through the cathode layer 72. In the case that the cathode layer is provided on the anode layer, the switching transistor may be still provided in the pixel, and detecting lines (not shown in the figures) may be provided on the sample substrate for connecting to a compensation module for external compensation.

Figure 6:
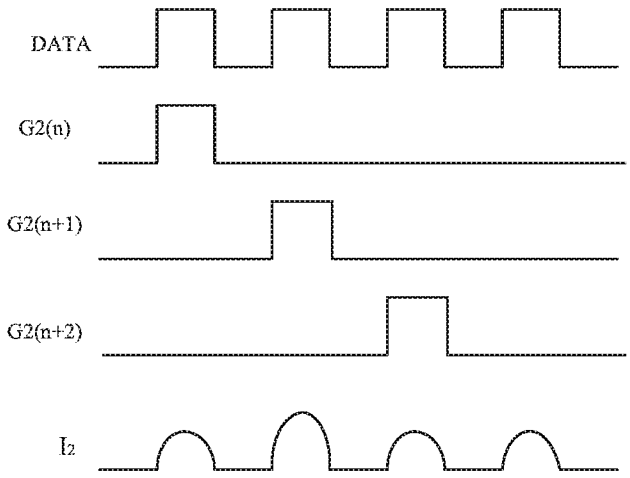
FIG. 6 is a waveform diagram of signals of respective signal lines in an embodiment of the present invention.

FIG. 6 shows a waveform diagram of the data voltage signal of one data line DATA. During scanning the pixels row by row, the current flowing through the cathode layer is indicated by $I_2$. When the $(n+1)^{th}$ row of pixels are scanned, if the current flowing through the cathode layer is different from the predefined current, it is judged that there is at least one defective pixel among the $(n+1)^{th}$ row of pixels. Then, the data voltage signal is provided to the pixels among the $(n+1)^{th}$ row of pixels having the defective pixel, every time when the data voltage signal is provided, the second detecting sub-module 32 detects a corresponding anode current, and when the anode current detected by the second detecting sub-module 32 is inconsistent with the predefined current, the corresponding pixel is judged as the defective pixel, thus the specific position of the defective pixel is determined.

Further, as shown in FIG. 2, the second judging module 50 may comprise an image generating sub-module 51 and an image comparing sub-module 52.

The image generating sub-module 51 generates a first image from the test result of the array test performed by the array test module 10 on the sample substrate, and generates a second image from the judgment result of the first judging module 40 on the sample substrate. The first image comprises a plurality of pixel points corresponding to the pixels of the sample substrate, when the array test module 10 judges that a pixel is a normal pixel, the pixel point in the first image corresponding to the pixel has a first color, and when the array test module 10 judges that a pixel is a defective pixel, the pixel point in the first image corresponding to the pixel has a second color; and, the second image also comprises a plurality of pixel points corresponding to the pixels of the sample substrate, when the first judging module 40 judges that a pixel is a normal pixel, the pixel point in the second image corresponding to the pixel has the first color, and when the first judging module 40 judges that a pixel is a defective pixel, the pixel point in the second image corresponding to the pixel has the second color.

The image comparing sub-module 52 is configured to compare the first image and the second image, when each pixel point in the first image has the same color as that of the corresponding pixel point in the second image, it is judged that the array test performed by the array test module 10 is reliable, otherwise, it is judged that the array test performed by the array test module 10 is unreliable.

It should be understood that, in an ordinary organic light emitting display panel, a light emitting layer is provided between a cathode layer and a anode layer, the anodes in the anode layer correspond to a single cathode layer, and the cathode layer is connected to connection terminals of the display panel. When displaying, the connection terminals are connected to a low level signal terminal to form a current loop. In the present invention, the cathode layer may also be connected to connection terminals of the sample substrate and the second detecting sub-module 32 for detecting the anode current is connected to the connection terminals to form a circuit loop in detection.

It could be understood that the above embodiments are merely exemplary embodiments adopted for describing the principle of the present invention, but the present invention is not limited thereto. Various variations and improvements may be made for those with ordinary skill in the art without departing from the spirit and essence of the present invention, and these variations and improvements shall also fall within the protection scope of the present invention.

The invention claimed is:

1. A judging method of array test reliability of an organic light emitting backplane, the organic light emitting backplane comprising a pixel circuit layer and an anode layer, the anode layer comprising an anode in each pixel of the organic light emitting backplane, the judging method of array test reliability comprising;

Step 1, taking at least one of organic light emitting backplanes subjected to an array test as a sample substrate;

Step 2, performing a scan on pixels of the sample substrate row by row and providing a data voltage signal;

Step 3, detecting a current that is output to the anode of each pixel from the pixel circuit layer;

Step 4, comparing the current that is output to the anode of each pixel from the pixel circuit layer with a predefined current, and judging that a pixel is a defective pixel when the current that is output to the anode of the pixel from the pixel circuit layer is inconsistent with the predefined current; and Step 5, comparing a judgment result of each pixel with a test result of the array test, judging that the array test is reliable when the judgment result is consistent with the test result, and judging that the array test is unreliable when the judgment result is inconsistent with the test result, the judging method of array test reliability further comprising a step to be performed between the Step 1 and the Step 2:

Step 1.5, electrically connecting the anodes in a plurality of pixels, wherein, the Step 3 comprises: detecting a corresponding anode current every time when one row of pixels are scanned;

the Step 4 comprises:

Sub-step 4-1, comparing a detected anode current with the predefined current, judging that there is no defective pixel in the row of pixels corresponding to the detected anode current when the detected anode current is consistent with the predefined current, and judging that there is at least one defective pixel in the row of pixels corresponding to the detected anode current when the detected anode current is inconsistent with the predefined current;

Sub-step 4-2, providing a scanning signal to the row of pixels having the defective pixel, and providing a data voltage signal sequentially to each pixel;

Sub-step 4-3, detecting an anode current corresponding to each pixel; and

Sub-step 4-4, comparing each anode current with the predefined current, and judging that a pixel corresponding to an anode current among the row of pixels having defective pixel is the defective pixel when the anode current is inconsistent with the predefined current.

2. The judging method of array test reliability of claim 1, wherein the Step 1.5 comprises: providing a cathode layer on the anode layer of the sample substrate to electrically connect the anodes in the pixels.

3. The judging method of array test reliability of claim 2, wherein a first image is generated from the test result of the array test performed on the sample substrate, the first image comprises a plurality of pixel points corresponding to the pixels of the sample substrate, when a pixel is judged as a normal pixel in the array test, the pixel point in the first image corresponding to the pixel has a first color, and when a pixel is judged as a defective pixel in the array test, the pixel point in the first image corresponding to the pixel has a second color;

the judging method of array test reliability further comprises a step to be performed between the Step 4 and the Step 5: generating a second image from the judgment result of the Step 4, the second image comprising a plurality of pixel points corresponding to the pixels of the sample substrate, when a pixel is judged as a normal pixel in the Step 4, the pixel point in the second image corresponding to the pixel has the first color, and when a pixel is judged as a defective pixel in the Step 4, the pixel point in the second image corresponding to the pixel has the second color;

the Step 5 comprises: comparing the first image and the second image, and judging that the array test is reliable when each pixel point in the first image has the same color as that of the corresponding pixel point in the second image, otherwise, judging that the array test is unreliable.

4. The judging method of array test reliability of claim 1, wherein a first image is generated from the test result of the array test performed on the sample substrate, the first image comprises a plurality of pixel points corresponding to the pixels of the sample substrate, when a pixel is judged as a normal pixel in the array test, the pixel point in the first image corresponding to the pixel has a first color, and when a pixel is judged as a defective pixel in the array test, the pixel point in the first image corresponding to the pixel has a second color;

the judging method of array test reliability further comprises a step to be performed between the Step 4 and the Step 5: generating a second image from the judgment result of the Step 4, the second image comprising a plurality of pixel points corresponding to the pixels of the sample substrate, when a pixel is judged as a normal pixel in the Step 4, the pixel point in the second image corresponding to the pixel has the first color, and when a pixel is judged as a defective pixel in the Step 4, the pixel point in the second image corresponding to the pixel has the second color;

the Step 5 comprises: comparing the first image and the second image, and judging that the array test is reliable when each pixel point in the first image has the same color as that of the corresponding pixel point in the second image, otherwise, judging that the array test is unreliable.

5. The judging method of array test reliability of claim 1, wherein a first image is generated from the test result of the array test performed on the sample substrate, the first image comprises a plurality of pixel points corresponding to the pixels of the sample substrate, when a pixel is judged as a normal pixel in the array test, the pixel point in the first image corresponding to the pixel has a first color, and when a pixel is judged as a defective pixel in the array test, the pixel point in the first image corresponding to the pixel has a second color;

the judging method of array test reliability further comprises a step to be performed between the Step 4 and the Step 5: generating a second image from the judgment result of the Step 4, the second image comprising a plurality of pixel points corresponding to the pixels of the sample substrate, when a pixel is judged as a normal pixel in the Step 4, the pixel point in the second image corresponding to the pixel has the first color, and when a pixel is judged as a defective pixel in the Step 4, the pixel point in the second image corresponding to the pixel has the second color;

the Step 5 comprises: comparing the first image and the second image, and judging that the array test is reliable when each pixel point in the first image has the same color as that of the corresponding pixel point in the second image, otherwise, judging that the array test is unreliable.

6. A testing method of an organic light emitting backplane, comprising steps of:

performing an array test on a plurality of organic light emitting backplanes; and judging reliability of the array test by the judging method of array test reliability of claim 1;

when it is judged that the array test is unreliable, the testing method comprises: adjusting the array test, and performing the adjusted array test on the sample substrate until the test result of the array test is consistent with the judgment result in the Step 4.

7. The testing method of an organic light emitting backplane of claim 6, wherein the step of adjusting the array test comprises: adjusting test conditions of the array test.

* * * * *